US009347227B2

(12) United States Patent
Ramachandra et al.

(10) Patent No.: US 9,347,227 B2
(45) Date of Patent: May 24, 2016

(54) FLOATING FLOOR SYSTEM, FLOOR PANEL, AND INSTALLATION METHOD FOR THE SAME

(71) Applicant: ARMSTRONG WORLD INDUSTRIES, INC., Lancaster, PA (US)

(72) Inventors: Sunil Ramachandra, Lancaster, PA (US); Anna J. Totaro, Hummelstown, PA (US)

(73) Assignee: Armstrong World Industries, Inc., Lancaster, PA (US)

( * ) Notice: Subject to any disclaimer, the term of this patent is extended or adjusted under 35 U.S.C. 154(b) by 0 days.

(21) Appl. No.: 14/394,157

(22) PCT Filed: Apr. 15, 2013

(86) PCT No.: PCT/US2013/036663

§ 371 (c)(1),
(2) Date: Oct. 13, 2014

(87) PCT Pub. No.: WO2013/155534

PCT Pub. Date: Oct. 17, 2013

(65) Prior Publication Data

US 2015/0113908 A1 Apr. 30, 2015

Related U.S. Application Data

(60) Provisional application No. 61/623,670, filed on Apr. 13, 2012.

(51) Int. Cl.
*E04F 15/02* (2006.01)
*E04F 15/10* (2006.01)

(52) U.S. Cl.
CPC ..... *E04F 15/02022* (2013.01); *E04F 15/02038* (2013.01); *E04F 15/105* (2013.01);

(Continued)

(58) Field of Classification Search
CPC ..... E04F 2201/0535; E04F 2201/0146; E04F 15/02022; E04F 15/02038
USPC ..... 52/588.1
See application file for complete search history.

(56) References Cited

U.S. PATENT DOCUMENTS 4,426,820 A * 1/1984 Terbrack ..... E01C 13/107 52/590.1
6,647,690 B1 * 11/2003 Martensson ..... 52/601

(Continued)

FOREIGN PATENT DOCUMENTS

CN 2535489 2/2003
CN 2559710 Y 7/2003

(Continued)

OTHER PUBLICATIONS

International Search Report mailed Jul. 24, 2013 and Written Opinion issued in corresponding International Application PCT/US2013/036663. WO.

(Continued)

*Primary Examiner* — Adriana Figueroa
(74) *Attorney, Agent, or Firm* — Christina W. Geerlof

(57) ABSTRACT

A floating floor system and a floor panel and method for use with the same that includes a snap-fit locking assembly that provides vertical locking between adjacent floor panels to minimize and/or prevent ledging therebetween. In one embodiment, a protuberance and a recess are also provide on the floor panels to provide horizontal locking. The snap-fit locking assembly comprises: a locking member protruding from a first flange and comprising an undercut surface; and a locking slot formed in a second flange. The snap-fit locking assembly is configured so that when the locking member of a first one of the panels is disposed within the locking slot of a second one of the panels, the first and second panels are vertically locked together via mechanical interaction between the undercut surface of the locking member of the first panel and a locking surface of the second flange of the second panel.

17 Claims, 9 Drawing Sheets

(52) U.S. Cl.
CPC . *E04F2201/0146* (2013.01); *E04F 2201/0176* (2013.01); *E04F 2201/021* (2013.01); *E04F 2201/0535* (2013.01)

(56) References Cited

U.S. PATENT DOCUMENTS

| | | | | |
|---|---|---|---|---|
| 6,769,219 | B2 * | 8/2004 | Schwitte | E04F 15/02 52/590.3 |
| 6,862,857 | B2 * | 3/2005 | Tychsen | E04F 15/02 52/582.1 |
| 7,600,354 | B2 * | 10/2009 | Knauseder | 52/592.2 |
| 8,191,333 | B2 * | 6/2012 | Braun | 52/745.19 |
| 8,484,924 | B2 * | 7/2013 | Braun | 52/588.1 |
| 8,505,257 | B2 * | 8/2013 | Boo et al. | 52/582.1 |
| 8,793,959 | B2 | 8/2014 | Ruland | |
| 8,833,028 | B2 * | 9/2014 | Whispell | E04F 15/02 52/588.1 |
| 2003/0101681 | A1 | 6/2003 | Tychsen | |
| 2011/0030303 | A1 | 2/2011 | Pervan et al. | |
| 2011/0225922 | A1 | 9/2011 | Pervan et al. | |
| 2013/0047536 | A1 | 2/2013 | Pervan | |

FOREIGN PATENT DOCUMENTS

| | | | | |
|---|---|---|---|---|
| CN | 101042011 | A | 9/2007 | |
| CN | 101042012 | A | 9/2007 | |
| CN | 202012176 | U | 10/2011 | |
| CN | 102235076 | A | 11/2011 | |
| DE | 10231921 | A | 1/2004 | |
| DE | 102007020271 | | 8/2008 | |
| DE | 102008021970 | A1 * | 11/2009 | E04F 15/02 |
| EP | 1350904 | A2 * | 10/2003 | E04F 15/04 |
| JP | 2010242423 | | 10/2010 | |
| WO | 2008122479 | | 10/2008 | |

OTHER PUBLICATIONS

Pervan, Darko, "VA073A Zip Loc," IP.COM Journal, IP.COM Inc., West Henrietta, NY. Published Sep. 13, 2011. XP013144910. US.

AU Search Report mailed Aug. 5, 2015 in corresponding AU Application No. 2013245653. AU.

CN Search Report mailed Dec. 4, 2015 in corresponding CN Application No. 2013800197117. CN.

* cited by examiner

FLOATING FLOOR SYSTEM, FLOOR PANEL, AND INSTALLATION METHOD FOR THE SAME

CROSS-REFERENCE TO RELATED PATENT APPLICATIONS

The present application claims the benefit of U.S. Provisional Patent Application Ser. No. 61/623,670, filed Apr. 13, 2012, the entirety of which is incorporated herein by reference.

FIELD OF THE INVENTION

The present invention relates generally to floor systems, floor panels, and installation methods thereof, and particularly to an enhanced mechanical lock system for said floor systems, floor panels, and installation methods thereof. The present invention is particularly suited for floating floor systems, such as those that utilize resilient panels, such as LVT (Luxury Vinyl Tile).

BACKGROUND OF THE INVENTION

Floating floor systems are known in the art. In existing floating floor systems, the floor panels are typically interlocked together via chemical adhesion. For example, the floor panels of existing floating floor systems generally comprise a lower lateral flange and an upper lateral flange extending from opposite sides of the floor panel body. At least one of the upper and/or lower lateral flanges has an exposed adhesive applied thereto. In assembling/installing such a floating floor system, the lower flanges of the floor panels are overlaid by the upper flanges of adjacent ones of the floor panels. As a result, the exposed adhesive interlocks the upper and lower flanges of the adjacent floor panels together. The assembly/installation process is continued until the entire desired area of the sub-floor is covered.

Recently, attempts have been undertaken to develop floating floor systems in which the floor panels mechanically interlock. One known mechanical interlocking floating floor system utilizes teeth and tooth slots on the upper and lower flanges respectively that mate with one another to create a horizontal interlock between the floor panels. One problem, with these existing mechanical interlocking systems is that the teeth are not easily alignable with the slots, thereby making the installation/assembly process difficult. Additionally, these mechanical interlock systems are limited to providing horizontal locking and, thus, ledging between adjacent floor panels can become an issue.

It is generally known in the art that floorboards with a wood based core may be provided with a mechanical locking system and methods of assembling such floorboards by angle-angle, angle-snap or vertical folding. Floor panels of resilient material, such as LVT (Luxury Vinyl Tile) are traditionally glued down to the subfloor or bonded at the edges to each other.

The known methods of assembling floorboards with a wood based core that are mentioned above are difficult to use when assembling resilient floor panels, as resilient floor panes are not rigid and have a thin profile, thereby allowing the floor panels to be easily bent. Thus, the use of the angle-angle method is difficult. In addition, the use of the angle-snap method is rendered impracticable since it requires a force to be applied at an opposite edge in relation to the edge of the floor panel which is intended to be connected, by e.g. a hammer and a tapping block, and the resilient core of the resilient floor panel absorbs the applied force and will likely undergo some damage which may be visually undesirable for an end user. The known vertical folding methods are also difficult to apply due to the increased flexibility of the resilient floor pane allowing the resilient floor panels to disengage more easily than a rigid based floorboard using the same method.

The angled type of a lock on the long side, the short side, or both is significantly more difficult to install than a lock that can be pushed down or snapped down vertically. However, the vertical fold or push down type locks currently in the market can easily pop open or exhibit "ledging" on square edge products due to subfloor irregularities or any significant relative vertical movement between two locked planks.

The issue with ledging is becoming increasingly pronounced, as do-it-yourself (DIY) type products need to have a square edge (and not a beveled edge) because these products must be price competitive, which means that the DIY products cannot have a thick wear layer which is needed for a beveled edge product. Consequently, a square edged DIY product is needed in which the risk of ledging or popping open is minimized or essentially eliminated. Therefore, one benefit of this invention is that it makes it possible for a DIY type product with a thin wear layer to have square edges without the risk of ledging or popping open.

Thus, a need exists for an improved floating floor system, floor panel, and method of installing the same that utilizes a mechanical interlocking system. Such a need is especially felt for resilient floor panels, such as LVT panels.

BRIEF SUMMARY OF THE INVENTION

The present invention is directed to a floating floor system and a floor panel and method for use with the same that includes a snap-fit locking assembly that provides vertical locking between adjacent floor panels to minimize and/or prevent ledging therebetween. In one embodiment, the floor panels are resilient floor panels, such as LVT. A protuberance and a recess may also be provided on the floor panels to provide horizontal locking. The snap-fit locking assembly may comprise: a locking member protruding from a first flange and comprising an undercut surface; and a locking slot formed in a second flange. The snap-fit locking assembly is configured so that when the locking member of a first one of the panels is disposed within the locking slot of a second one of the panels, the first and second panels are vertically locked together via mechanical interaction between the undercut surface of the locking member of the first panel and a locking surface of the second flange of the second panel.

In one embodiment, the invention can be a floating floor system comprising: a plurality of panels, each of the panels comprising: a panel body comprising a first edge and a second edge opposite the first edge; a first flange extending from the first edge of the panel body; a second flange extending from the second edge of the panel body; a snap-fit locking assembly comprising: a locking member protruding from the first flange and comprising an undercut surface; and a locking slot formed in the second flange; and wherein the snap-fit locking assembly is configured so that when the locking member of a first one of the panels is disposed within the locking slot of a second one of the panels, the first and second panels are vertically locked together via mechanical interaction between the undercut surface of the locking member of the first panel and a locking surface of the second flange of the second panel.

In another embodiment, the invention can be a floating floor system comprising: a plurality of panels, each of the panels comprising: a panel body comprising a first edge and a second edge opposite the first edge; a first flange extending from the first edge of the panel body; a second flange extending from the second edge of the panel body; a snap-fit locking assembly comprising: a locking member protruding from the first flange; and a locking slot formed in the second flange; and wherein the panels are vertically locked together via mechanical interaction between the locking member of a first one of the panels and the locking slot of a second one of the panels.

In yet another embodiment the invention can be a floor panel for a floating floor system comprising: a panel body comprising a first edge and a second edge opposite the first edge: a first flange extending from the first edge of the panel body; a second flange extending from the second edge of the panel body; a snap-fit locking assembly comprising: a locking member protruding from a the first flange and comprising an undercut surface; a locking slot formed in the second flange; and a locking surface on the second flange adjacent the locking slot; and wherein the snap-fit locking assembly is configured so that when the locking member of the floor panel is disposed within the locking slot of an adjacent floor panel, the floor panel and the adjacent floor panel are vertically locked together via mechanical interaction between the undercut surface of the locking member of the floor panel and the locking surface of the second flange of the adjacent floor panel.

In a further embodiment, the invention can be a method of installing a plurality of panels to create a floating floor system, each of the panels comprising: a panel body comprising a first edge and a second edge opposite the first edge; a first flange extending from the first edge of the panel body; a second flange extending from the second edge of the panel body; a snap-fit locking assembly comprising: a resilient locking member protruding from the first flange; and a locking slot formed into the second flange, the method comprising: a) positioning first and second ones of the plurality of panels adjacent to one another; b) inserting the resilient locking member of a first one of the panels into the locking slot of a second one of the panels, the resilient locking, member of the first panel being forced from a normal state to a deflected state; and c) continuing step b) until the resilient locking member of the first panel returns to the normal state so that mechanical interaction between the undercut surface of the locking member of the first panel and a locking surface of the second panel vertically locks the first and second panels together.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
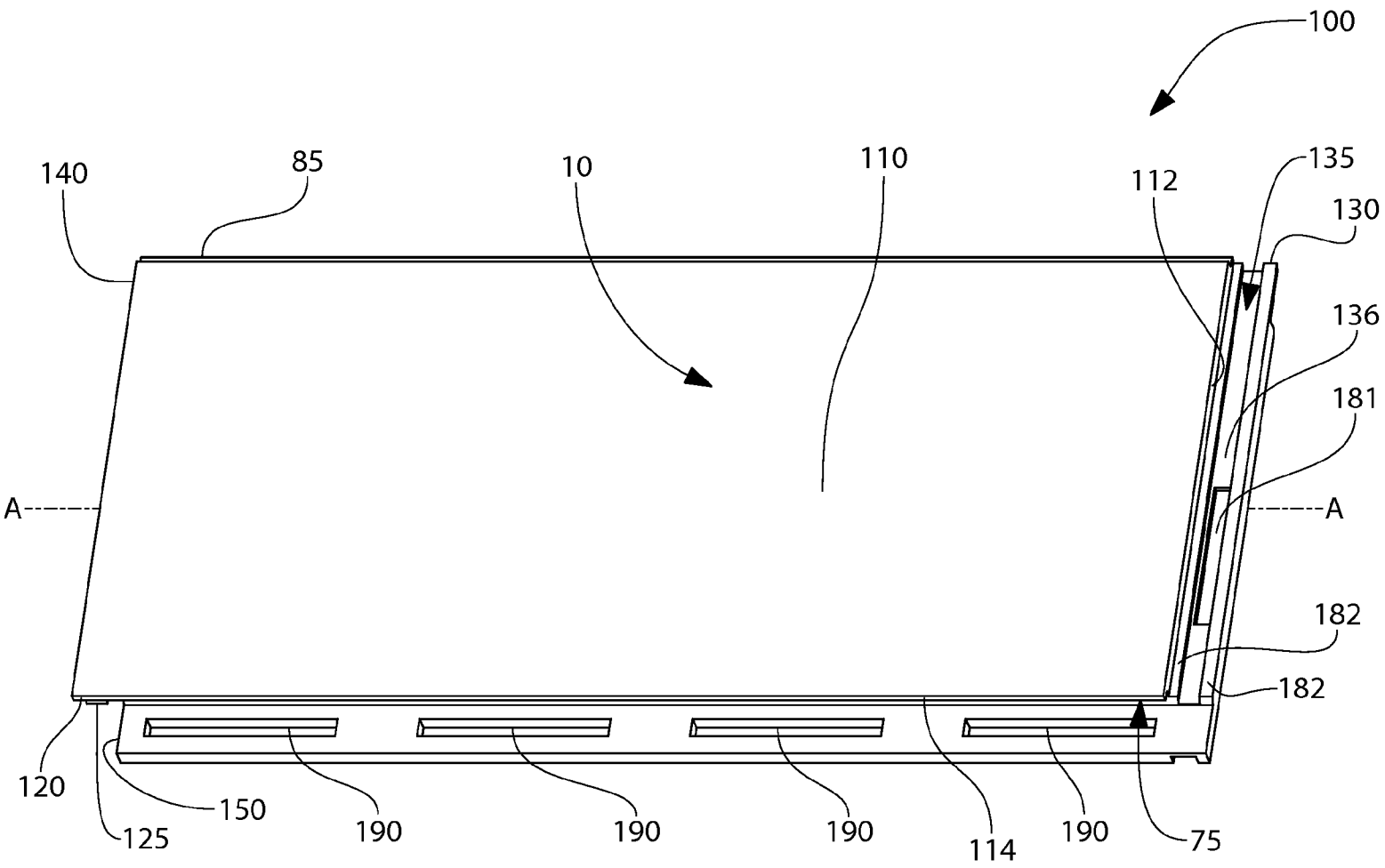
FIG. 1 is a top perspective view of a floor panel according to one embodiment of the present invention.

The following description of the preferred embodiment(s) is merely exemplary in nature and is in no way intended to limit the invention, its application, or uses. The description of illustrative embodiments according to principles of the present invention is intended to be read in connection with the accompanying drawings, which are to be considered part of the entire written description. Moreover, the features and benefits of the invention are illustrated by reference to the exemplified embodiments. Accordingly, the invention expressly should not be limited to such exemplary embodiments, which illustrate some possible non-limiting combinations of features that may exist alone or in other combinations of features; the scope of the invention being defined by the claim appended hereto.

Referring first to FIGS. 1-4 concurrently, a floor panel 100 according to an embodiment of the present invention is illustrated. In one embodiment, the floor panel 100 may be a vinyl tile, having a composition and laminate structure as disclosed in United States Patent Application Publication No. 2010/0247834, published Sep. 30, 2010, the entirety of which is hereby incorporated by reference in its entirety. However, unlike the vinyl tile disclosed in United States Patent Application Publication No. 2010/0247834, the floor panel 100 comprises a mechanical locking system to interlock adjacent floor panels 100 to form a floating floor. Additionally, while the inventive panel 100 is referred to herein as a "floor panel," it is to be understood that the inventive floor panel 100 can be used to cover other surfaces, such as wall surfaces.

The floor panel 100 generally comprises a top surface 10 and an opposing bottom surface 11. The top surface 10 is intended to be visible when the floor panel 100 is installed and, thus, may be a finished surface comprising a visible decorative pattern. To the contrary, the bottom surface 11 is intended to be in surface contact with the surface that is to be covered, such as a top surface of a sub-floor. The term sub-floor, as used herein, is intended to include any surface that is to be covered by the floor panels 100, including without limitation plywood, existing tile, cement board, concrete, wall surfaces, hardwood planks and combinations thereof. Thus, in certain embodiments, the bottom surface 11 may be an unfinished surface.

The floor panel 100 extends along a longitudinal axis A-A. In the exemplified embodiment, the floor panel 100 has a rectangular shape. In other embodiments of the invention, however, the floor panel 100 may take on other polygonal shapes. The floor panel 100 has a panel length measured along the longitudinal axis A-A and a panel width measured in a direction transverse to the longitudinal axis A-A. In certain such embodiments (such as the exemplified one), the floor panel 100 is an elongated panel such that the panel length is greater than the panel width. In other embodiments, however, the floor panel 100 may be a square panel in which the panel length is substantially equal to the panel width.

The floor panel 100 generally comprises a panel body 110, a first flange 120 extending from the panel body 110, and a second flange 130 extending loan the panel body 110. In the exemplified embodiment, due to the top surface 10 being the intended, display surface of the floor panel 100, the first flange 120 may be considered an upper flange while the second flange 130 may be considered a lower flange. In other embodiments, however, the floor panel 100 may be designed such that the second flange 130 is an upper flange that forms a portion of the top surface 10 of the floor panel 100 while the first flange 120 is a lower flange that forms a portion of the bottom surface 11.

The floor panel 100, in certain embodiments, further comprises a third flange 140 and a fourth flange 150. In the exemplified embodiment, due to the top surface 10 being the intended display surface of the floor panel 100, the third flange 140 may also be considered an upper flange while the second flange 130 may be considered a lower flange. In other embodiments, however, the floor panel 100 may be designed such that the third flange 140 is an upper flange that forms a portion of the top surface 10 of the floor panel 100 while the first flange 120 is a lower flange that forms a portion of the bottom surface 11.

In the exemplified embodiment, the third flange 140 is connected to and integrally formed with the first flange 120 so as to collectively form an L-shaped flange about two adjacent edges of the panel body 110 as illustrated. Similarly, the fourth flange 150 is connected to and integrally formed with the second flange 130 so as to collectively form an L-shaped flange about the remaining two adjacent edges of the panel body 110 as illustrated.

The first flange 120 extends from a first edge 111 of the panel body 110 while the first flange 130 extends from a second edge 112 of the panel body 110 that is opposite the first edge 111. Similarly, the third flange 140 extends from a third edge 113 of the panel body 110 while the fourth flange 150 extends from a fourth edge 114 of the panel body 110 that is opposite the third edge 113. In the exemplified embodiment, the first edge 111 is a proximal edge of the panel both 110 while the second edge 112 is a distal edge of the panel body 110, wherein the longitudinal axis A-A extends between the first and second edges 112, 113 (and thus the first and second flanges 120, 130). The third and fourth edges 113, 114, however, form first and second lateral edges of the panel body 110 respectively.

In the exemplified embodiment, each of the first, second, third and fourth flanges 120, 130, 140, 150 is a continuous flange that extends along substantially the entire edge 111-114 form which it extends. In other embodiments, however, one or more of the first, second, third and fourth flanges 120, 130, 140, 150 may be discontinuous so as to comprises a plurality of flange segments that are separated, by a gap and collectively be considered to form the flange.

The first and second flanges 120, 130 are provided so that when a plurality of the floor panels 100 are arranged end-to-end (distal end to proximal end) to form a row of the floor panels 100 during installation (see FIGS. 6 and 9A-9D), the first and second flanges 120, 130 overlap and mechanically interlock using a snap-fit locking assembly (described in greater detail below) with one another to prevent vertical separation between the floor panels 100. The third and fourth flanges 140, 150 are provided so that when a plurality of the floor panels 100 are arranged laterally adjacent (side-to-side) to form adjacent rows of the floor panels 100 during installation (see FIGS. 9A-9D), the third and fourth flanges 140, 150 overlap and mechanically interlock using, a tooth/tooth slot mating (described in greater detail below) that prevents horizontal separation between the floor panels 100 in a first horizontal direction while allowing relative sliding therebetween in a second horizontal direction that is substantially orthogonal to the first horizontal direction.

As will be discussed in greater detail below, the snap-fit locking assembly, in other embodiments, can be provided along the first and second lateral edges of the panel body 110 (in addition to or instead of along the proximal and distal edges) to mechanically interlock floor panels 100 of adjacent rows using the snap-fit locking assembly to vertically lock floor panels 100 of adjacent rows together. In such an embodiment, the flanges extending from the first and second lateral edges (i.e., the third and fourth edges 113, 114) can be considered the first and second flanges 120, 130.

As mentioned above, the floor panel 100 comprises a snap-fit locking assembly for vertically locking adjacent floor panels 100 together during installation of a floating floor system utilizing the floor panels 100. As used herein, the term "vertical" refers to a direction substantially orthogonal to the plane of the top surface 10 of the floor panel 10. The term "first horizontal direction" refers to a direction substantially parallel to the longitudinal axis. The term "second horizontal direction" refers to a direction substantially perpendicular to the longitudinal axis and the plane of the of the top surface 10 of the floor panel 10.

Figure 2:
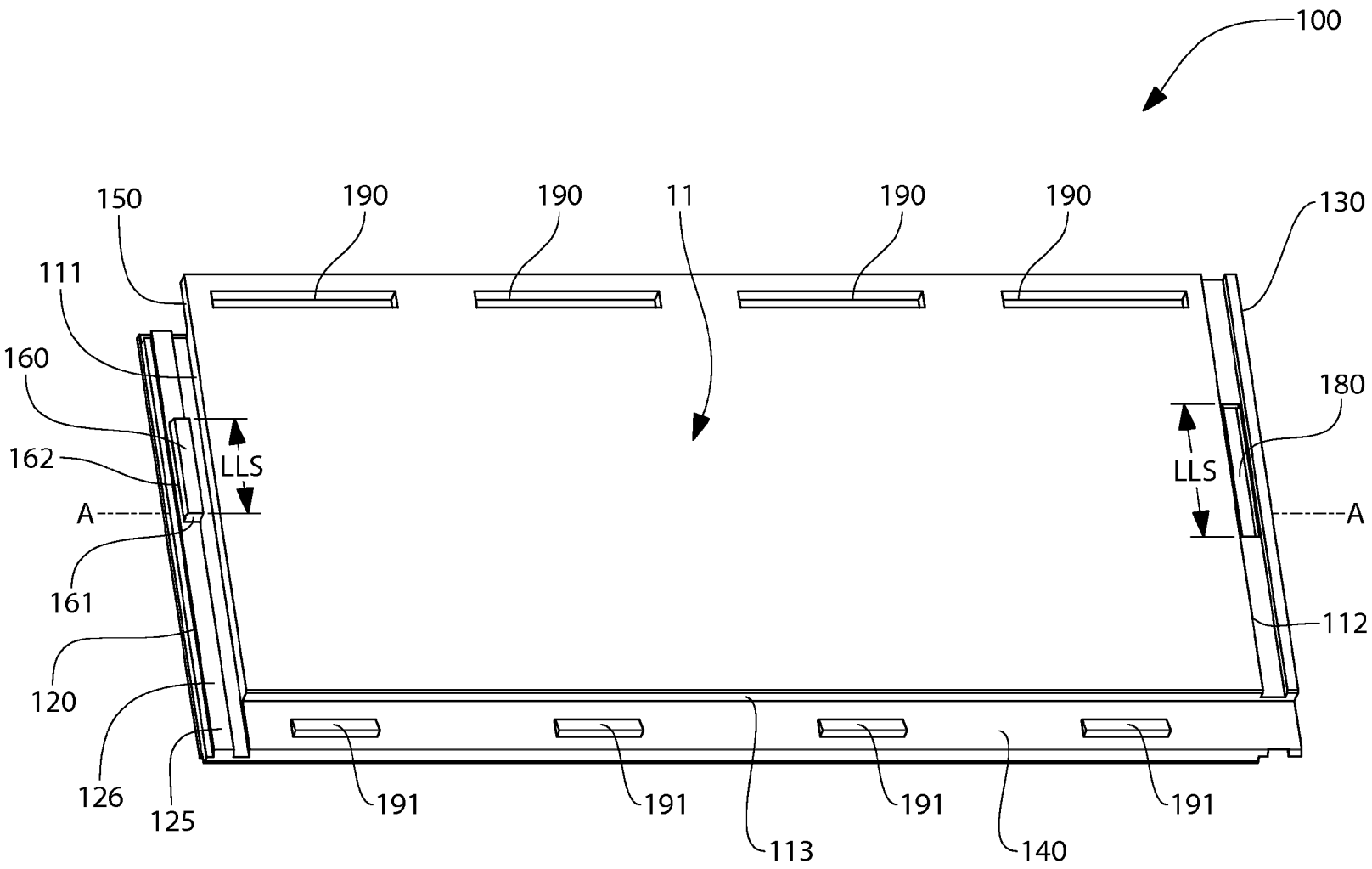
FIG. 2 is a bottom perspective up of the floor panel of FIG. 1.
Figure 2A:
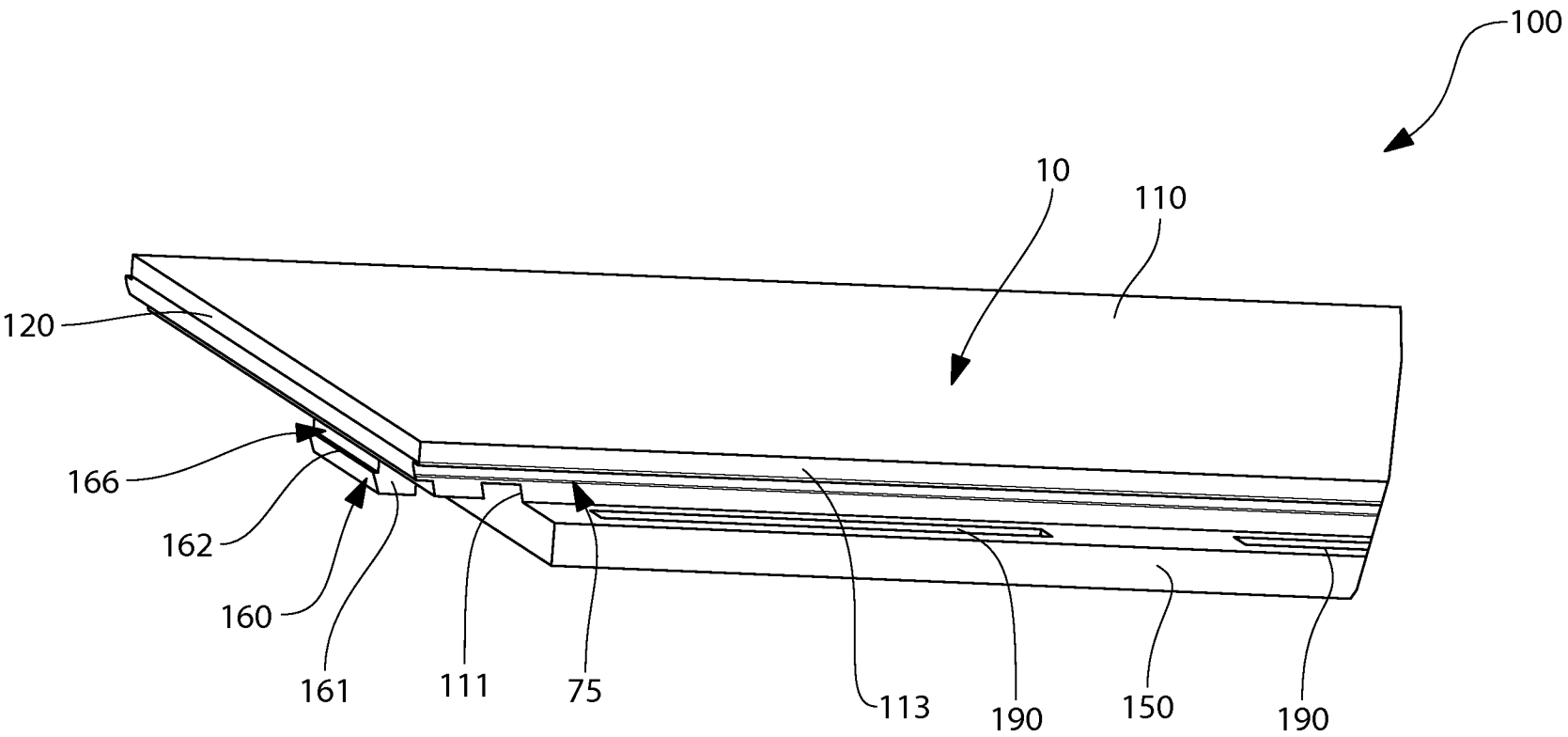
FIG. 2A is a bottom perspective view of a proximal end portion of the floor panel of FIG. 1.
Figure 3:
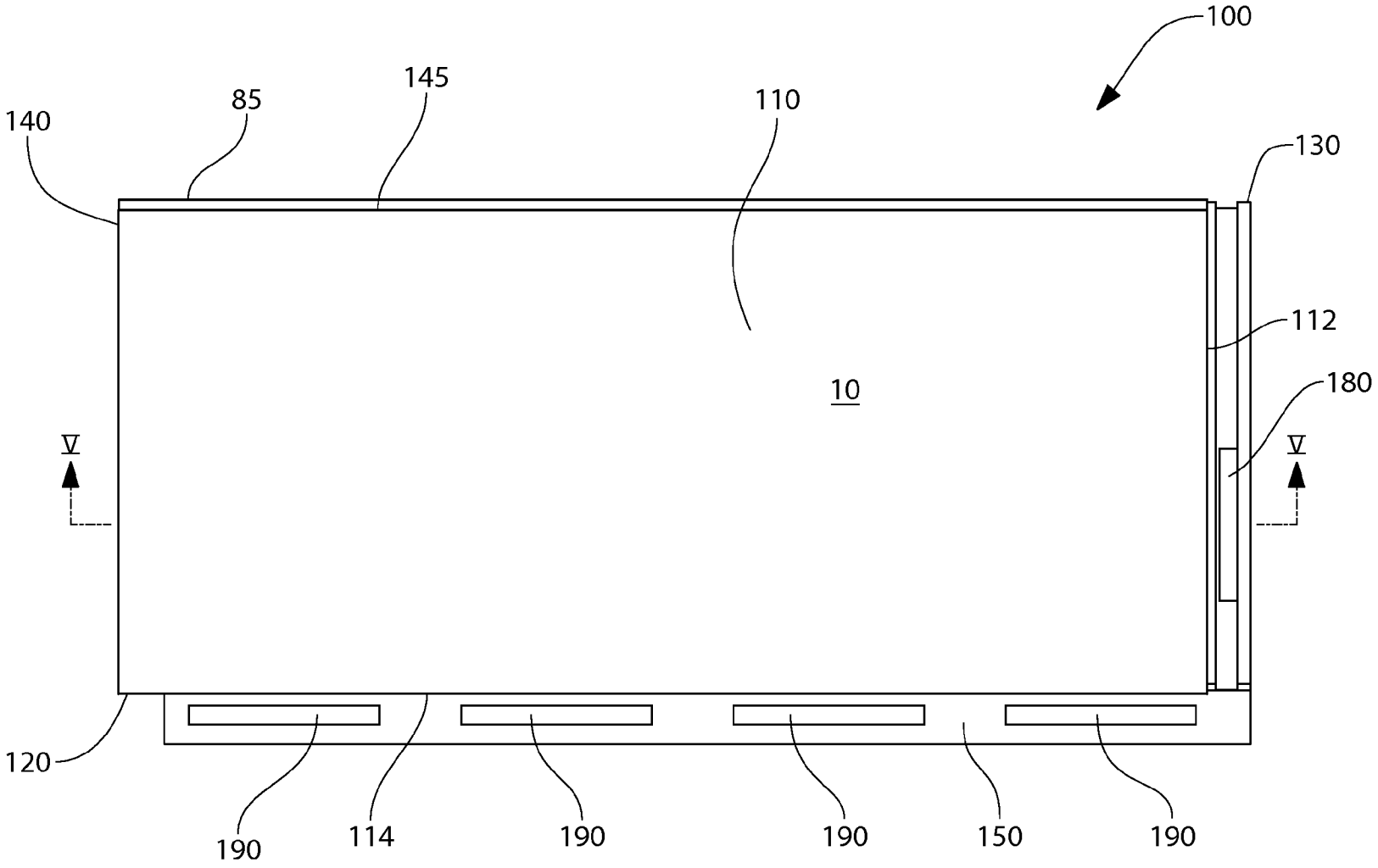
FIG. 3 is a top view of the floor panel of FIG. 1.
Figure 4:
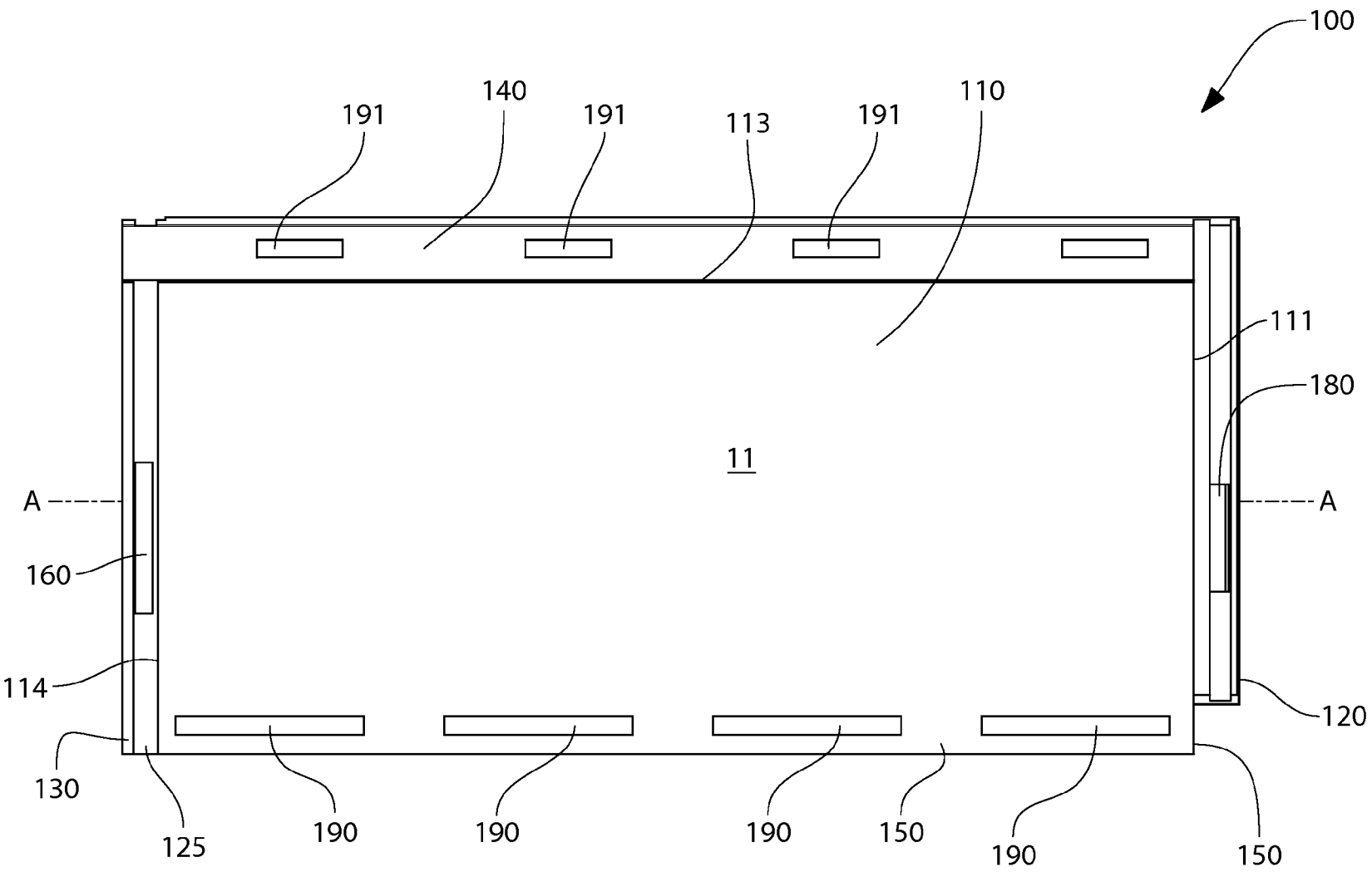
FIG. 4 is a bottom view of the floor panel of FIG. 1.
Figure 5:
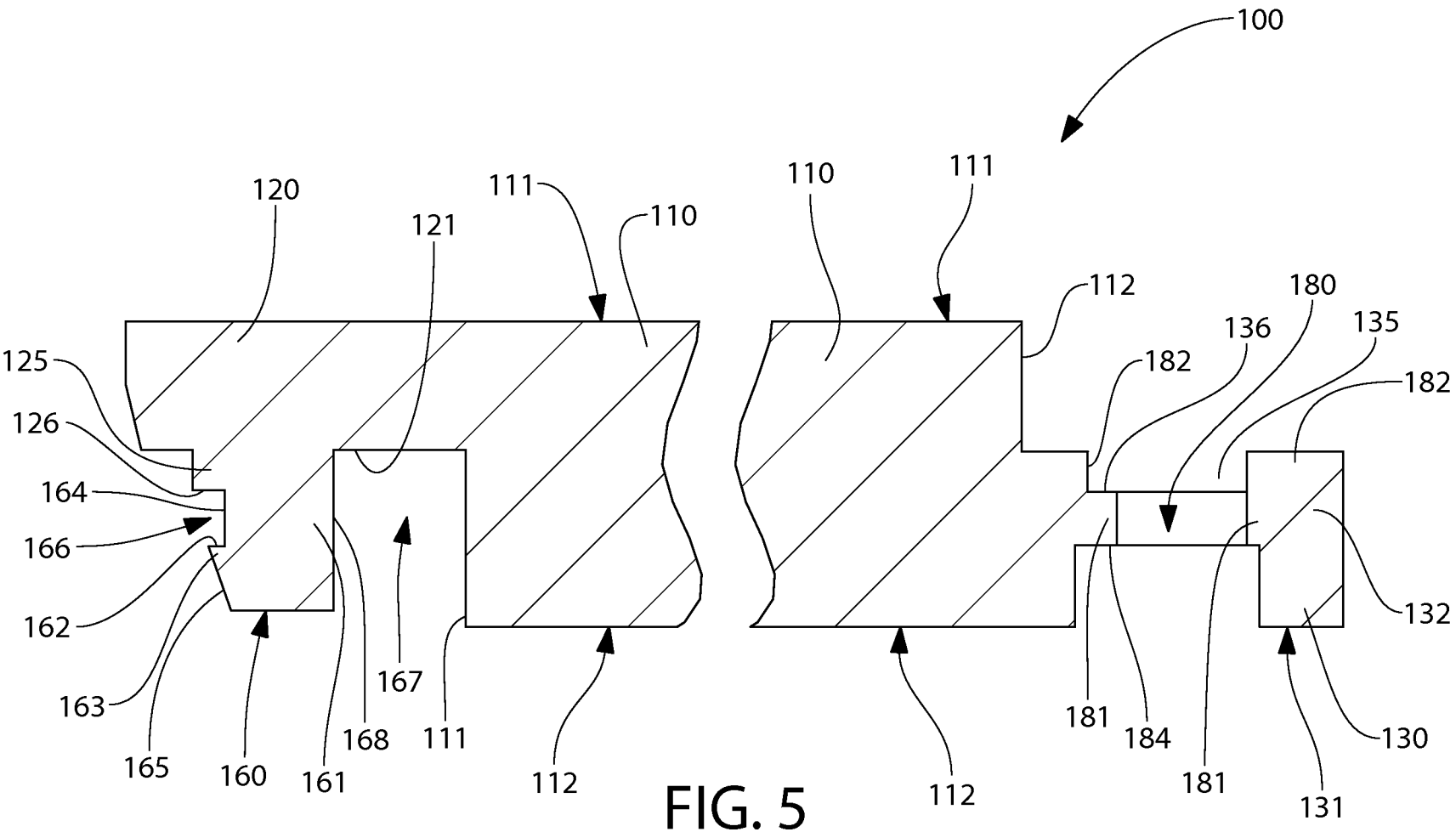
FIG. 5 is a cross-sectional view of the floor panel of FIG. 1 taken along view V-V of FIG. 3.

Referring now to FIGS. 2, 2A and 5 concurrently, the snap-fit locking assembly of the floor panel 100 will be described in greater detail. The snap-fit locking assembly generally comprises a locking member 160 protruding from the first flange 120 and a locking slot 180 formed in the second flange 130 for receiving the locking member 160 of an adjacent one of the floor panels 100 as discussed below. The locking member 160, in the exemplified embodiment, is integrally formed with the first flange 120. In other embodiments, however, the locking member 160 may be a separate component that is later fixed to the first flange 120.

The locking member 160 protrudes from a first surface 121 of the first flange. The locking member 160 generally comprises a locking body 161 and an undercut surface 162. A locking groove 166 is formed between the undercut surface 162 and the first flange 120. In the exemplified embodiment, the undercut surface 162 is formed by a locking lip 163 that protrudes from a side surface 164 of the locking body 161. More specifically, the locking lip 163 protrudes from the side surface 164 of the locking body 161 in a direction away from the panel body 110. In other embodiments, the locking lip 163 may protrude from the side surface 168 of the locking body 161 in a direction toward the panel body 110.

As can be seen, a lead end of the locking lip 163 comprises a chamfered surface 165 to facilitate entry of the locking member 160 into the locking slot 180 during installation of a floor using the floor panels 100. As will be discussed in greater detail below, when adjacent floor panels 100 are coupled together using the snap-fit locking assembly, the chamfered surface 165 interacts with a wall 181 of the second flange 130 that defines the locking slot 180 to deflect the locking member 160 (which is resilient) from a normal state (as shown in FIG. 5) to a deflected state (not shown). The chamfered surface 165, in one embodiment, is in a range of 5 to 15 degrees from vertical. When the locking member 160 is fully inserted into the locking slot 180 of an adjacent one of the floor panels 100, the wall 181 of the adjacent floor panel nests within the locking groove 166 (see FIG. 8).

While the undercut surface 162 is formed on the locking lip 16 in the exemplified embodiment, the undercut surface 162 may be formed directly into the locking body 161 in other embodiments. In such an embodiment, the wall 181 of the locking slot 180 may itself comprise a locking lip protruding into the locking slot 180 that extends into engagement with the undercut surface 162.

The undercut surface 162 is substantially parallel to a top surface 111 of the panel body 110 (the top surface 111 of the panel body 110 forms a portion of the top surface 10 of the floor panel 100). In other embodiments, the undercut surface 162 may be oblique relative to the top surface 111 of the panel body 110. On the opposite side of the locking member, a gap 167 exists between the locking body 161 and the panel body 110. As discussed in greater detail below, this gap 167 provides a space for receiving a raised wall 182 of the second flange 130 that defines a recess 135 that, in part, provides for horizontal locking of adjacent floor panels 100. The locking member has a length $L_{LM}$. The locking slot has a length $L_{LS}$. In eon embodiment, $L_{LM}$ is less than $L_{TS}$. In one specific embodiment, a $L_{TS}$ is greater than or equal to 1.2 $L_{LM}$. This allows the locking member 160 to be inserted into the locking slot 180 during installation of the floor without the needs for exact precision. This also allows the locking member 160 to be folded down into the locking slot 180, in addition to a straight "push-down." In embodiments where the snap-fit locking assembly of the locking member 160 and the locking slot are utilized along the lateral edges 113, 114 of the panel body to achieve vertical locking between floor panels of adjacent rows, designing $L_{TS}$ to be greater $L_{LM}$ allows for relative sliding to minimize the need for precision cuts. In such an embodiment, $L_{TS}$ is greater than or equal to 1.5 $L_{LM}$.

The locking slot 180 is a through-slot in the exemplified embodiment in that it forms a passageway through the second flange 130. In other embodiments, however, the locking slot 180 may not be a through-slot but may rather be a depression with a floor. Such an embodiment is especially useful when the second flange 130 is to be the "upper flange" of the floor panel 100 as discussed above as it eliminates the locking slots 180 from being visible on the installed floor. As mentioned above, in an embodiment where the locking slot 180 is not a through-slot, a locking lip may be provided that protrudes into the locking slot 180 from the inner wall of the locking slot 180 to engage the undercut surface 162 of the locking member 160. Alternatively, a groove may be provided in the inner wall of the locking slot 180 to receive the locking lip 161 163 of the locking member.

The locking slot is defined by the wall 181. Moreover, the second flange 130 comprises a locking surface 184 adjacent to the edge of the locking slot 180. As discussed in greater detail below, when the locking member 160 of an adjacent floor panel 100 is fully inserted into the locking slot 180, mechanical interaction between the undercut surface 162 of the locking member 160 and the locking surface 184 vertically lock the floor panels together. The locking surface 184 is vertically offset from a bottom surface 112 of the panel body 110 (the bottom surface 112 of the panel body 110 forms a portion of the bottom surface 11 of the floor panel 100). This allows the locking member 160 to full nest within in a manner that allows the undercut surface 162 to mechanically engage the locking surface 142 without the locking member 160 protruding beyond a plane formed by the bottom surface 112 of the panel body 110. Additionally, while the locking surface 184 is located between the second edge 112 of the panel body 1110 and the locking slot 180 in the exemplified embodiment, in other embodiments the locking surface 184 may be located at other positions adjacent the locking slot.

Moreover, the second flange 130 has a bottom surface 131 on the opposite side of the locking slot 180 that is substantially coplanar to the bottom surface 112 of the panel body 110. This assist in preventing the strut portion 132 of the second flange 130 from becoming deflected after installation of the floor when experiencing a vertical load. As a result, the resiliency of the vertical locking over time is further improved.

As exemplified, the locking member 160 is an elongated rectangular member while the locking slot 180 is also an elongated rectangular slot. In other embodiments, however, the locking member 160 and the locking slot 180 may take on other shapes, such as square, polygonal, oval or circular. For example, in one such embodiment, the locking member 160 can be a cylindrical element. State simply, the locking member 160 and the locking slot 180 can be any shape, so long as the vertical locking function can be achieved.

Referring now to FIGS. 1-2 and 5, the first flange 120 is further provided with a protuberance 125 while the second flange 130 is provided with a corresponding recess 135. The recess 135 is sized and shaped to receive the protuberance 125 to provide horizontal locking between adjacent floor panels 100 in at least the first horizontal direction. More specifically, when the protuberance 125 of one of the floor panels 100 is inserted into the recess 135 of another one of the floor panel 100, the floor panels 100 become horizontally locked together via mechanical interaction between the protuberance 125 of the one floor panel 100 and the walls 182 of the recess 135 of the other floor panel 100 (see FIG. 8).

In the exemplified embodiment, the protuberance 125 is in the form of an elongated ridge while the recess 135 is in the form a corresponding elongated channel. The elongate ridge, which can be considered to be a "fold-down step," may extend across a portion of the width of the first flange 120 of the floor panel 100 or the entirety thereof. Similarly, the elongated channel, which can be considered a "fold-down slot," may extend across a portion of the width of the second flange 130 of the floor panel 100 or the entirety thereof. Other configurations are, of course, possible.

In other embodiments, the protuberance 125 and recess 135 can take on other shapes that can mate with one another to provide the desired horizontal locking in at least the first horizontal direction. In the exemplified embodiment, the locking slot 180 is located on a floor 136 of the recess 135 and the locking member 160 is located on the protuberance 125. More specifically, the locking member 160 protrudes downwardly from a distal surface 126 of the protuberance 125. In other embodiments, the locking member 160 and the protuberance 125 may be isolated from one another while the locking slot 180 and the recess 135 may also be isolated from one another.

Referring again to FIG. 1, the floor panel 100 further comprises a groove 75 located in the fourth edge 114 of the body 110 (see also FIG. 2). This grove 75 extends the entire length of the floor panel 100 in a continuous manner. Alternatively, it or can be segmented or extend only a portion of the length of the panel floor 100. Additionally, the floor panel 100 also comprises a complimentary projection 85 that extends from a free lateral edge 145 of the third flange 140. The projection 85 has an upper surface that is offset from the top surface 10 of the floor panel 100. The projection 85 extends the entire length of the floor panel 100 in a continuous manner. Alternatively, it or can be segmented or extend only a portion of the length of the panel. As will be described in greater detail below, the projection 85 of a floor panel 100 is inserted into a groove 75 of a floor panel 100 in an adjacent row during a fold-down vertical locking procedure.

Figure 6:
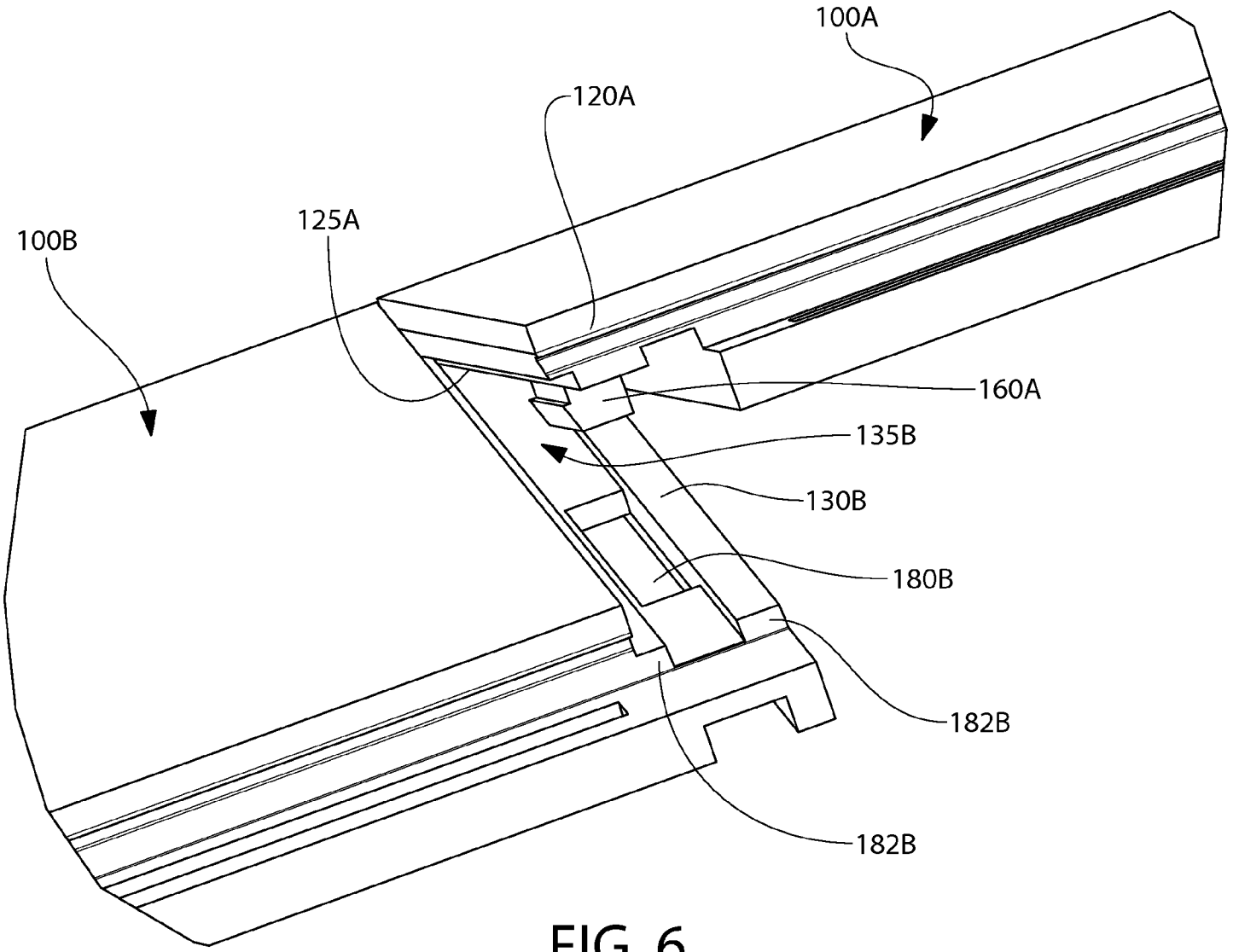
FIG. 6 is a perspective view of first and second ones of the floor panel of FIG. 1 being vertically locked together using a snap-fit assembly according to an embodiment of the present invention.
Figure 7:
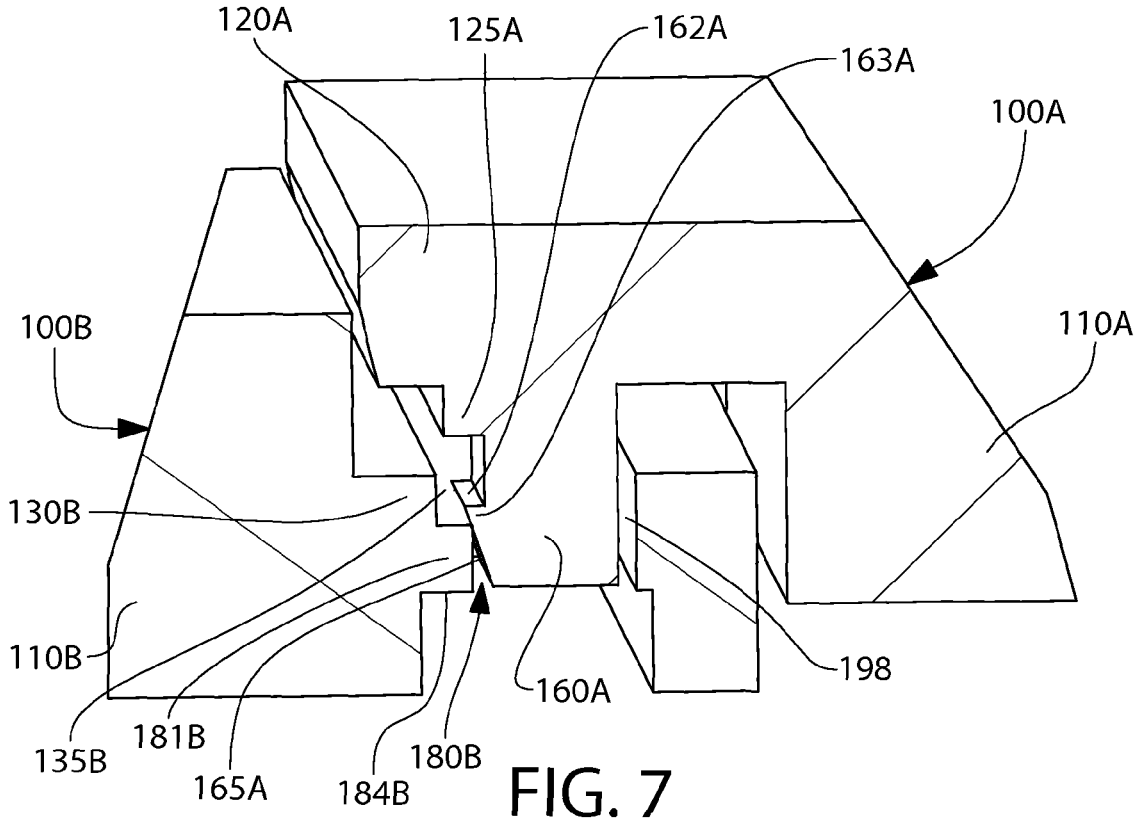
FIG. 7 is a cross-sectional view of a locking member of a first one of the floor panel of FIG. 1 entering a locking slot of a second one of the floor panel of FIG. 1.
Figure 8:
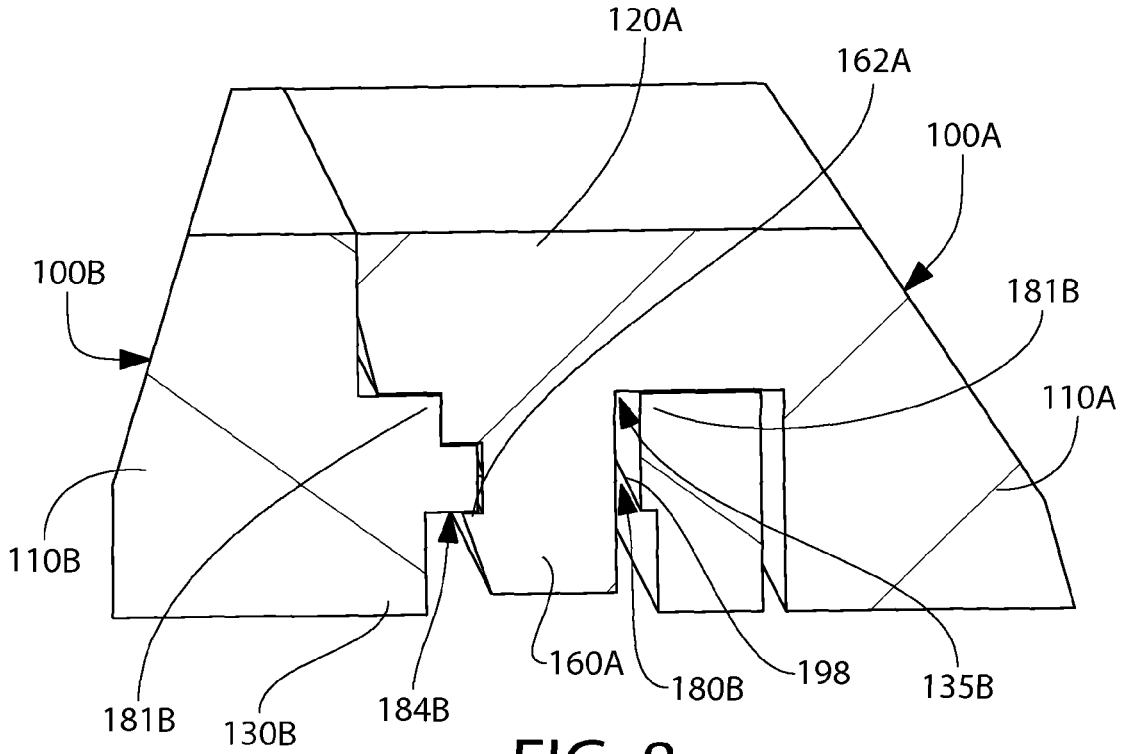
FIG. 8 is a cross-sectional view of the locking member of the first one of the floor panel of FIG. 1 disposed within the locking slot of the second one of the floor panel of FIG. 1 to effectuate vertical locking therebetween.

Referring now to FIGS. 6-8, the vertical locking of two longitudinally adjacent floor panels 100 in a row will be discussed. For ease of reference and discussion, these floor panels 100 are numerically identified as a first floor panel 100A and a second floor panel 100B. The floor panels 100A, 100B are identical to the floor panel 100 discussed above (and identical to each other). Thus, like numbers will be used to refer to like elements with the addition of the suffix "A" for the first floor panel 100A and the suffix "B" for the second floor panel 100B.

Beginning with FIG. 6, the second floor panel 100B is positioned in a desired location on the surface to be covered. Once so positioned, the first floor panel 100A is positioned adjacent the second floor panel 100B so that the first flange 120A of the first floor panel 100A overlies the second flange 130 of the second floor panel 100B. When utilizing the fold-down method (as shown in FIG. 6), the first floor panel 100A is then tilted about its longitudinal axis A-A and lowered until an end portion of the protuberance 125 of the first floor panel 100A is inserted into the recess 135B of the second floor panel 100B. In an installation where a previous row of the floor panels 100 has been installed, this step may also include inserting the projection 85 of the first panel 100A into a groove 75 of one of the floor panels in a row of panels adjacent the row in which the second panel 100B is located (see FIGS. 1 and 9C-D).

The raised lateral edge of the first floor panel 100A is then lowered so that more of the length of the protuberance 125A is inserted into the recess 135B. As a result of the mechanical interaction/contact (i.e., mechanical interference or abutment) between the protuberance 125A of the first floor panel 100A and the walls 182B that define the recess 135B of the second floor panel 100B, the first and second panels 100A, 100B are horizontally locked together in the first horizontal direction.

Referring now to FIG. 7, the above-referenced lowering occurs until the lead end of the locking member 160A begins to enter the locking slot 180B. At this time, the chamfered surface 165A of the locking lip 163A of the locking member 160A comes into contact with the wall 181B that defines the locking slot 180B. As downward force is continued to be applied, a force is exerted on the locking member 160B that moves the locking member 160A from the normal state (FIG. 7) to a deflected state (not shown). In the illustrated embodiment, the locking member 160 will deflect into the deflection gap 198 so as to allow the locking lip 163A to fully enter the locking slot 180. As mentioned above, the locking member 160A is resilient and, thus, is continually self-biased to press the locking lip 163A against the wall 181B during said insertion.

Referring now to FIG. 8, downward insertion of the locking member 160A into the through slot 180B continues until the undercut surface 162A comes into alignment with locking surface 184. In the embodiment in which the locking slot 180 is a through-slot, this occurs when the undercut surface exits the locking slot 180 on the opposite from which it entered. At this point, because the locking member 160 is self-biased, the locking member 160A automatically returns to the normal state in which the undercut surface 162A is in abutment with the locking surface 184B. As a result of this mechanical interaction between the undercut surface 162A and the locking surface 184B, the first and second panels 100A, 100B are vertically locked together. As can be seen, in this state, the wall 181B that defines the locking slot 180B is nested within the locking groove 166 (FIG. 5) of the first panel 100A.

Moreover, despite a deflection gap 198 existing after the locking member 160 returns to the normal state, the first and second floor panels 100A, 100B are horizontally locked due to the continued mechanical interaction between the protuberance 125A of the first floor panel 100A and the walls 182B of the recess 135B of the second floor panel 100B. Thus, the locking member 160A cannot be backed out of the locking slot 180B without breaking or undergoing further deflection. Additionally, the horizontal locking achieved by the protuberance 125A and the recess 135B prior to the locking member 160 entering the locking slot 180B assists in maintaining, the relative positions of the first and second floor panels 100A, 100B so that deflection of locking member 160A is effectuated.

While in the exemplified embodiment the width of the locking member 160A is slightly less than the width of the locking slot 180B so that the deflection gap 198 exists (and into which the locking member 160A deflects), in other embodiments the widths of the locking member 160A and locking slot 180B can be substantially equal (except for a small tolerances). In such an embodiment, the locking lip 163A can itself deflect or be compressed so as to allow the locking tab 160A to full enter the locking slot 180B to achieve the desired vertical locking. In such an embodiment, said deflection Or compression of the locking lip 163A can be considered the deflected state of the locking member 160A. In still other embodiments, the resilient action of the snap-fit locking assembly can be provided in whole, or in part, by deflection of the strut portion 132B of the second flange 130B.

As exemplified, the locking member 160A is designed to be resilient to deflect during insertion and snap back into place once it passes through the locking slot 180B. However, as an alternative or in addition to having the locking member 160A, a softer material can be used to form the locking member 160, such as one that is compressible. This makes the vertical locking action possible by compressing the locking member 160A instead of or in addition to resiliently deflecting. The softer layer or layers could be achieved by using more plasticizer, using a softer copolymer, higher binder/filler ratio, and different types of resins.

While the vertical locking of the first and second floor panels 100A, 100B is described above using a fold-down method, a vertical push-down method can also be used. Moreover, the snap-fit vertical locking assembly (i.e., the locking member 160 and the locking slot 180) can be included on either the long side (lateral sides) or the short sides (distal and proximal ends). The snap-fit assembly described above will not pop up or disengage easily or exhibit lodging or vertical movement after installation. Moreover, while only a single locking member 160 and locking slot 180 are exemplified, in other embodiments the snap-fit locking assembly may comprise multiple locking members 160 and locking slots 180 arranged in corresponding patterns on opposing flanges so that mating can be effectuated. In certain embodiments, the floor panel 100 is a resilient floor panel. In one such example, the floor panel 100 may be made of a thermoplastic, e.g. vinyl, surlyn, and PVC.

As discussed above, the locking member 160 mechanically cooperates with the locking surface 184 adjacent the locking slot 180 to effectuates vertical locking, which minimizes ledging. In addition, the mechanical interaction of the protuberance 125 and the recess 135 that effectuates horizontal locking prevents gapping.

Referring back to FIGS. 1 and 2 concurrently, the floor panel 100 comprises a plurality of teeth 191 protruding from the third flange 130 and a plurality of tooth slots 190 formed into the fourth flange 150. The tooth slots 190 are equi-spaced from one another along an axis that is substantially parallel to the longitudinal axis A-A. In the exemplified embodiment, each of the tooth slots 190 is an elongated slot.

The plurality of teeth 191 are spaced apart from one another. The teeth 191 and tooth slots are arranged on the floor panel 100 in a pattern corresponding to one another so that when two of the floor panels 100 are positioned laterally adjacent one another, the floor panels 100 can be interlocked together by inserting the teeth 191 of one of the laterally adjacent floor panels 100 into the tooth slots 190 of the other one of the floor panels 100. When two laterally adjacent floor panels 100 are interlocked together by inserting the teeth 191 of one floor panel 100 into the tooth slots 190 of another floor panel 100, mechanical interaction between the teeth 191 and the walls of the tooth slots 190 prevent relative movement between the floor panels 100 in the second horizontal direction when subjected to a horizontal loading force.

Moreover, due to each tooth slot 190 being designed to have a length that is greater than the length each of the teeth 191, the laterally adjacent first and second panels 100A, 100B can slide relative to one another in the first horizontal direction while remaining horizontally locked in the second horizontal direction. In one embodiment, the length of a tooth 191 is 1.5 times the length of the tooth slot 190. The details regarding one embodiment of a suitable design for the teeth 191 and the tooth slots 190 can be found in International Patent Application No. PCT/US13/27675, filed Feb. 23, 103, the entirety of which is hereby incorporated by reference in its entirety.

The snap-fit locking assembly described above is efficient and makes better use of the entire thickness of the floor panel 100, thereby allowing the locking member 160, teeth 191, tooth slots 191 and locking slot 180 to be integrally formed in the floor panel 100.

Figure 9:
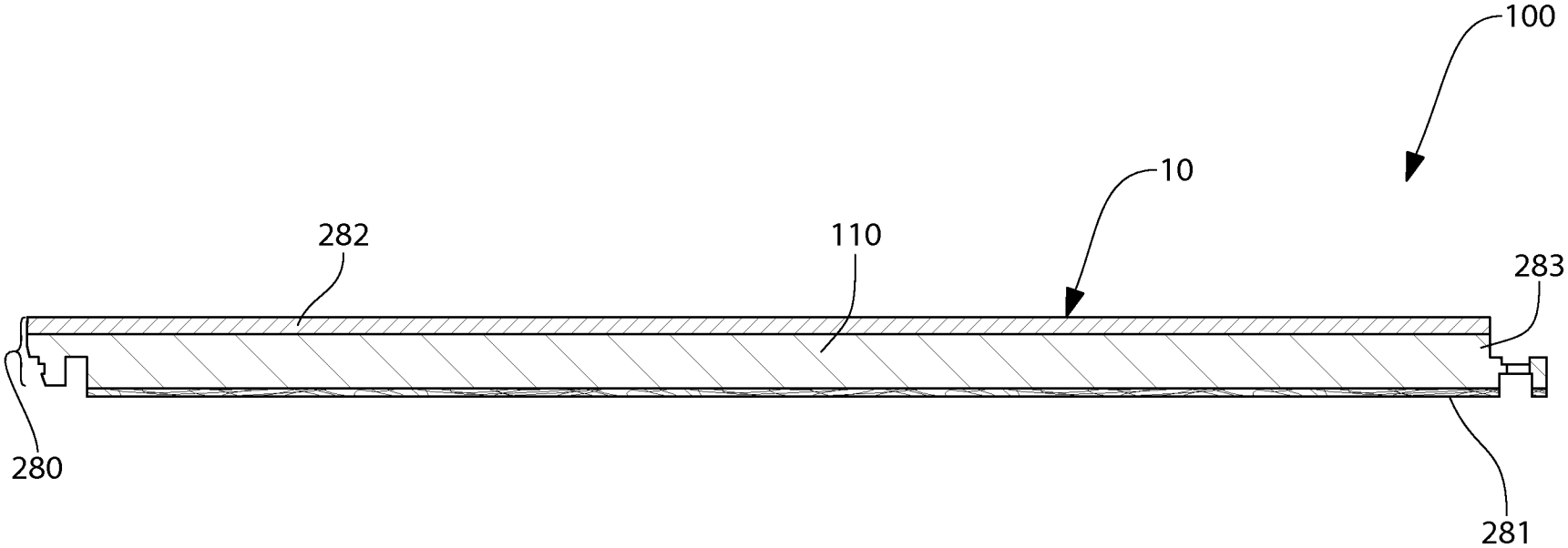
FIG. 9 is a cross-sectional schematic of a floor panel of FIG. 1 showing additional details thereof.

Referring now to FIG. 9, additional details of the floor panel 100 will be described. These details were omitted from the illustrations of FIGS. 1-8 in an attempt to avoid clutter and complexity of those figures. As shown in FIG. 10, the floor panel 100 may be a laminate structure comprising a top layer 280 and a bottom layer 281. Each of the top layer 280 and the bottom layer 281 may comprises a plurality of layers. In one such embodiment the top layer 280 may comprise a mix layer, a wear layer and a top coat layer. Moreover, in other embodiments, the floor panel 100 can comprise layers in addition to the top and bottom layers 280, 281, such as an intermediate fiberglass or polyester scrim layer. Additional layers may also include one or more of an antimicrobial layer, a sound deadening layer, a cushioning layer, a slide resistant layer, a stiffening layer, a channeling layer, a mechanically embossed texture, or a chemical texture.

In certain embodiments, the top surface 10 of the floor panel 100 and, thus, comprise a visible decorative pattern applied thereto. In one embodiment, the top layer 280 comprises a flexible sheet material comprising plastic, vinyl, polyvinyl chloride, polyester, or combinations thereof. The bottom layer 280, in certain embodiments, may comprise a flexible sheet material comprising, plastic, vinyl, polyvinyl chloride, polyester, polyolefin, nylon, or combinations thereof.

In one embodiment, the panel body 110 of the floor panel 100 has thickness in the range of 2 mm to 12 mm. In another embodiment, the body 110 of the floor panel 100 has thickness in the range of 2 mm to 5 mm. In one specific embodiment, the body 110 of the floor panel 100 has thickness in the range of 3 mm to 4 mm. The floor panel 100, in one embodiment, is designed so as to have a Young's modulus in a range of 240 MPA to 620 MPA. In another embodiment, the floor panel 100 is designed so as to have a Young's modulus in a range of 320 MPA to 540 MPA.

In the illustrated embodiment, the top layer 280 comprises a clear film/wear layer 282 positioned atop a top mix layer 283. The top mix 283 layer may be formed, for example, from a substantially flexible sheet material, such as plastic, vinyl, polyvinyl chloride, polyester, or combinations thereof. A visible decorative pattern is applied to the top surface of the top layer 280. The clear film/wear layer 282, in certain embodiments, may have a thickness of about 4-40 mils (about 0.1-1.0 millimeters), preferably about 6-20 mils (about 0.15-0.5 millimeters), and more preferably about 12-20 mils (about 0.3-0.5 millimeters).

The top layer 280, in certain embodiments may have a thickness of about 34-110 mils (about 0.8-2.8 millimeters), preferably about 37-100 mils (about 0.9-2.5 millimeters), and more preferably about 38-100 mils (about 1.0-2.5 millimeters).

The bottom layer 281, in the illustrated embodiment, comprises only a bottom mix layer. The bottom mix layer may be formed, for example, from a flexible sheet of material comprising plastic vinyl, polyvinyl chloride, polyester, polyolefin, nylon, or combinations thereof. The bottom layer 281 may also, in other embodiments, include recycle material, such as post-industrial or post-consumer scrap.

The bottom layer 281, certain embodiments, may have a thickness of about 34-110 mils (about 0.8-2.8 millimeters) preferably about 37-100 mils (about 0.9-2.5 millimeters), and more preferably about 38-100 mils (about 1.0-2.5 millimeters).

The bottom surface of the top layer 280 is laminated to the top surface of the bottom layer 281 by an adhesive. The adhesive may be, for example, any suitable adhesive, such as a hot melt adhesive, a pressure sensitive adhesive, or a structural and/or reactive adhesive. The adhesive may have, for example, a bond strength of at least 25 force-pounds, and more preferably about 4.3 N/mm after having been heat aged for about 24 hours at 145 degrees Fahrenheit. In the illustrated embodiment, the adhesive is provided on substantially an entirety of the top surface of the bottom layer 12. The adhesive may be applied to have a thickness, for example, of about 1-2 mils (about 0.0254-0.0508 millimeters). It will be appreciated by those skilled in the art, however, that the thickness of the adhesive may vary depending on the texture of the bottom surface of the top layer 280 and the texture of the top surface of the bottom layer 281 in that a substantially smooth surface would require less of the adhesive due to better adhesion and bond strength.

In one embodiment, in order to minimize the risk of shearing and/or delamination between the top layer 280 and the bottom layer 281 due to the stresses imparted by the mechanical interlock system (i.e., the locking member 160 and the locking slot 280) are formed by the same integrally formed layer (such as the top mix layer or the bottom mix layer). In the exemplified embodiment, the locking member 160 and the locking slot 280 are integrally formed by the top layer 280 (and more particularly the top mix layer).

The top and bottom mix layers are made from plasticizer, filler, and binder, and may be made in the following percentages for certain embodiments:

- Average % Plasticizer of Bottom Mix layer and the Top Mix layer (without the clear film): Range of 6.4% to 8.1%
- Average % Filler of Bottom Mix layer and the Top Mix layer (without the clear film): Range of 65.9% to 78.7%
- Average % Binder of Bottom Mix layer and the Top Mix layer (without the clear film): Range of 21.3% to 34.1%

By altering the percentages, the wear, flexibility and other performance characteristics of the floor panel 100 can be varied.

An advantage of utilizing the type of mechanical locking system described and shown above is that the joint can be locked using a vertical "fold down" type installation which is significantly easier than the "angle-angle" type installation of the prior art. Another advantage of using the protrusion and slot described is that the system can only be used in a joint that has a through-hole. Another advantage of the invention is that the profiles of the locking member 160 and the locking slot 180 can be machined with profiling equipment.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A floating floor system comprising:

a plurality of panels, each of the panels comprising:

a panel body comprising a first edge, a second edge opposite the first edge, a third edge, a fourth edge opposite the third edge, and a longitudinal axis extending parallel to the third and fourth edges;

a first flange extending from the first edge of the panel body;

a second flange extending from the second edge of the panel body;

a first mechanical locking assembly comprising:

a single locking member protruding from the first flange and comprising an undercut surface and a chamfered surface, the undercut surface and the chamfered surface defining a locking lip that protrudes in a direction away from the panel body; and a single locking slot formed in the second flange;

a second mechanical locking assembly comprising:

a first engagement member formed into the third edge of the panel body; and a first receiving member formed into the fourth edge of the panel body, the first engagement member configured to mate with the first receiving member;

wherein the first mechanical locking assembly and the second mechanical locking assembly are different types of mechanical locking assemblies;

wherein each of the first and second edges form a short side of the panel;

wherein each of the third and fourth edges form a long side of the panel; and wherein the first mechanical locking assembly is a snap-fit locking assembly and is configured so that when the locking member of a first one of the panels is disposed within the locking slot of a second one of the panels, the first and second panels are vertically locked together via mechanical interaction between the undercut surface of the locking member of the first panel and a locking surface of the second flange of the second panel;

wherein the locking member extends from a first end that is spaced from the third edge of the panel body along the first flange by a first distance to a second end that is spaced from the fourth edge of the panel body along the first flange by a second distance, the first distance being greater than the second distance such that the locking member is offset from the longitudinal axis of the panel body; and wherein for each of the panels, the locking slot is a through-slot.

2. The floating floor system according to claim 1, further comprising a protuberance extending from a lower surface of the first flange and terminating in a distal surface, the locking member extending from the distal surface of the protuberance and being recessed relative to a side surface of the protuberance thereby forming a locking groove between the undercut surface of the locking member and the distal surface of the protuberance.

3. The floating floor system according to claim 1, wherein a width of the locking member of the first panel is less than a width of the locking slot of the second panel thereby forming a deflection gap; and wherein the locking member is resilient so that the locking member of the first panel is forced from a normal state into a deflected state whereby the locking member deflects into the deflection gap as the locking lip is inserted into the locking slot of the second panel and returns to the normal state when the undercut surface of the locking lip of the first panel comes into alignment with the locking surface of the second panel.

4. The floating floor system according to claim 1, wherein for each of the panels, the locking member comprises a locking body, the locking lip protruding from a side surface of the locking body.

5. The floating floor system according to claim 2, wherein the second flange comprises a ledge extending from the second edge of the panel body that is recessed relative to a top surface of the panel body and a recess defined by a floor and a sidewall extending upwardly from the floor to the ledge, the locking slot being formed into the floor of the recess.

6. The floating floor system according to claim 5, wherein when the panels are vertically locked together, the lower surface of the first flange is in contact with an upper surface of the ledge, the side surface of the protuberance is in contact with the sidewall of the recess, and the floor of the recess of the second flange is in contact with the distal surface of the protuberance.

7. The floating floor system according to claim 4, wherein for each of the panels, a gap exists between the locking body and the panel body.

8. The floating floor system according to claim 1, wherein for each of the panels, the undercut surface is substantially parallel to a top surface of the panel body.

9. The floating floor system according to claim 1, wherein for each of the panels, the second flange comprises a recess and the first flange comprises a protuberance; and wherein the recess and the protuberance are configured so that when the protuberance of the first panel is inserted into the recess of the second panel, the first and second panels are horizontally locked together via mechanical interaction between the protuberance of the first panel and a wall of the recess of the second panel.

10. The floating floor system according to claim 9 wherein for each of the panels, the locking slot is located on a floor of the recess and the locking member is located on the protuberance, the recess being an elongated channel and the protuberance being an elongated ridge.

11. The floating floor system according to claim 1, wherein for each of the panels, the locking surface is vertically offset from a bottom surface of the panel body.

12. The floating floor system according to claim 11 wherein for each of the panels, the second flange has a bottom surface that is substantially coplanar to the bottom surface of the panel body.

13. The floating floor system according to claim 1, wherein for each of the panels, a locking groove is formed between the undercut surface and the first flange; and wherein when the first and second panels are vertically locked together, a wall that defines the locking slot of the second panel is nested within the locking groove of the first panel.

14. The floating floor system according to claim 1, wherein for each of the panels, the panel body is elongated and extends along the longitudinal axis from a proximal edge to a distal edge, the panel body further comprising a first lateral edge and a second lateral edge extending between the proximal and distal edges.

15. The floating floor system according to claim 14 wherein the first edge is the proximal edge and the second edge is the distal edge, the locking member located adjacent the proximal edge and the locking slot located adjacent the distal edge.

16. The floating floor system according to claim 1, wherein for each of the panels, the first flange comprises a top surface that is substantially coplanar with a top surface of the panel body.

17. The floating floor system according to claim 1, wherein each of the panels has a Young's modulus in a range of 240 MPA to 620 MPA.

* * * * *